US005628068A

United States Patent [19]

DeLong

[11] Patent Number: 5,628,068

[45] Date of Patent: May 13, 1997

[54] PITCHING GLOVE HAVING WEBBED FINGERS

[76] Inventor: Harold DeLong, 1145 Barham Dr. #209, San Marcos, Calif. 92069

[21] Appl. No.: 406,570

[22] Filed: Mar. 20, 1995

[51] Int. Cl.[6] ..... A41D 19/00; A63B 71/00

[52] U.S. Cl. ..... 2/161.1; 434/247; 473/458

[58] Field of Search ..... 2/19, 161.1, 161.2, 2/161.5, 161.6, 163, 907; 441/56, 57, 58; 273/26 R, 260, 26 C; 473/54, 55, 59, 60, 61, 106; 434/247, 249

[56] References Cited

U.S. PATENT DOCUMENTS

| | | | |
|---|---|---|---|
| 1,092,207 | 4/1914 | Fredrickson | 2/161.6 |
| 1,642,311 | 9/1927 | Richardson | 2/163 |
| 3,224,012 | 12/1965 | Hamm | 2/161.1 |
| 3,231,910 | 2/1966 | Tegland | 441/57 |
| 4,669,991 | 6/1987 | Southworth | 441/57 |
| 4,679,799 | 7/1987 | Coletti | 2/161.1 |
| 4,746,313 | 5/1988 | Bray et al. | 441/57 |
| 5,004,227 | 4/1991 | Hoffman | 441/57 |

FOREIGN PATENT DOCUMENTS

| | | | |
|---|---|---|---|
| 503982 | 9/1992 | European Pat. Off. | 441/57 |

*Primary Examiner*—C. D. Crowder
*Assistant Examiner*—Larry D. Worrell, Jr.
*Attorney, Agent, or Firm*—Ralph S. Branscomb

[57] ABSTRACT

A pitching glove is provided primarily for baseball and softball, in which the ball is thrown as in few other games. The glove has a body and only two fingers, the index and the middle finger, with a web spanning between them. The web serves both to train the fingers to remain in the proper pitching position, and may be used in play in unofficial games in which it serves to smoothly roll the ball out so that it is not deflected off-course by the index finger, and the flattened, flexible outermost portion of the web will track the ball and impart a substantial spin just as it leaves the hand.

1 Claim, 6 Drawing Sheets

PITCHING GLOVE HAVING WEBBED FINGERS

BACKGROUND OF THE INVENTION

Baseball, and to a lesser extent softball, is unique in the way in which the ball is pitched to the batter. Almost all other games of any popularity either use a large, soft ball such as basketball, volleyball or football, or a small ball which is struck with a stick or racket like polo or tennis. Baseball and its spinoffs may be unique in that the ball is actually grasped by hand, and an integral part of the play is pitching it at as great a speed as possible, imparting the maximum spin permitted by the skills of the pitcher.

Softball uses the same basic dynamics although the underhanded toss is much slower than baseball. In both cases however, the ball rolls off the fingers as it is propelled from the hand, and it is the way the hand is held which will determine if the pitch is accurate or not. Especially with softball, there is a tendency for the ball to "wobble" to the left or right off of the middle finger at the last instant, in parting it with a slight inaccuracy. Aside from the middle finger wobble, the configuration of the fingers, like almost any sport, has an optimal arrangement, with deviations being less than optimal. Although not a lot of practice time is devoted to configuring the fingers, this is an nevertheless integral part of accurate pitching. The quality of the pitch is dependent on the fingers being held consistently in the optimal position from one pitch to the next.

There is a vast array of training devices that have been invented, and in some cases produced and marketed for almost any aspect of any sport. There are numerous swing training devices for batting practice. However, there is nothing available to assist the baseball or softball pitcher in attaining and holding the correct finger posture for pitching the ball throughout the pitching stroke.

SUMMARY OF THE INVENTION

The instant invention fulfills this need by providing a glove which holds the fingers, specifically the index and middle finger, in the appropriate positions throughout the windup, if there is one, and the pitch itself, preventing the fingers from spreading too far and assisting in maintaining the middle finger in the proper position so that the ball does not roll off of it to one side or the other.

It is simple in concept, the body of the glove being very minimal, the idea being to cover no more than is necessary, leaving the hand virtually completely free to flex, other than the two fingers that are crucial in the execution of the pitching stroke. The two fingers covered by the glove have spanning between them a web which is substantially V-shaped and extends all the way from the crotch of the fingers to near the tips.

As the ball is thrown, the fingers are constrained by the web and cannot splay out into an awkward, or less than optimal, orientation. With the glove, this positioning of the ball between the two fingers is easy to do. Furthermore, the glove may be used not just for training but in actual play in some instances, in which case the travel of the ball across the last inch of the web serves to accelerate the ball as well as impart it with a spin, as the web frictionally engages the ball to a much greater degree and for a slightly longer duration than the two finger tips could by themselves.

DETAILED DESCRIPTIONS OF THE PREFERRED EMBODIMENT

Figure 1:
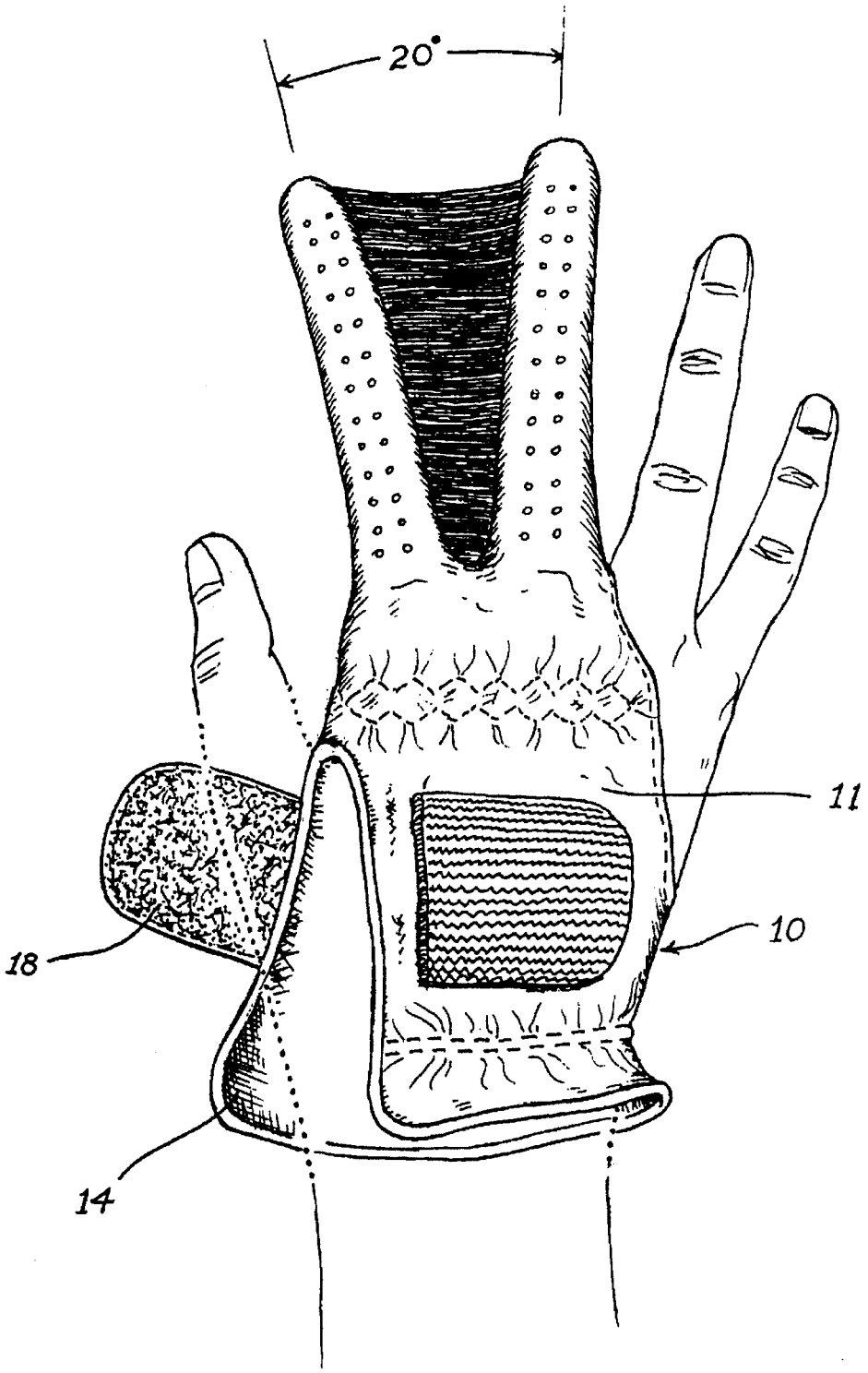
FIG. 1 is a rear elevation view of the glove on a hand showing the V-shaped web that spans between the fingers and the hook-and-loop connector tab unfastened.
Figure 2:
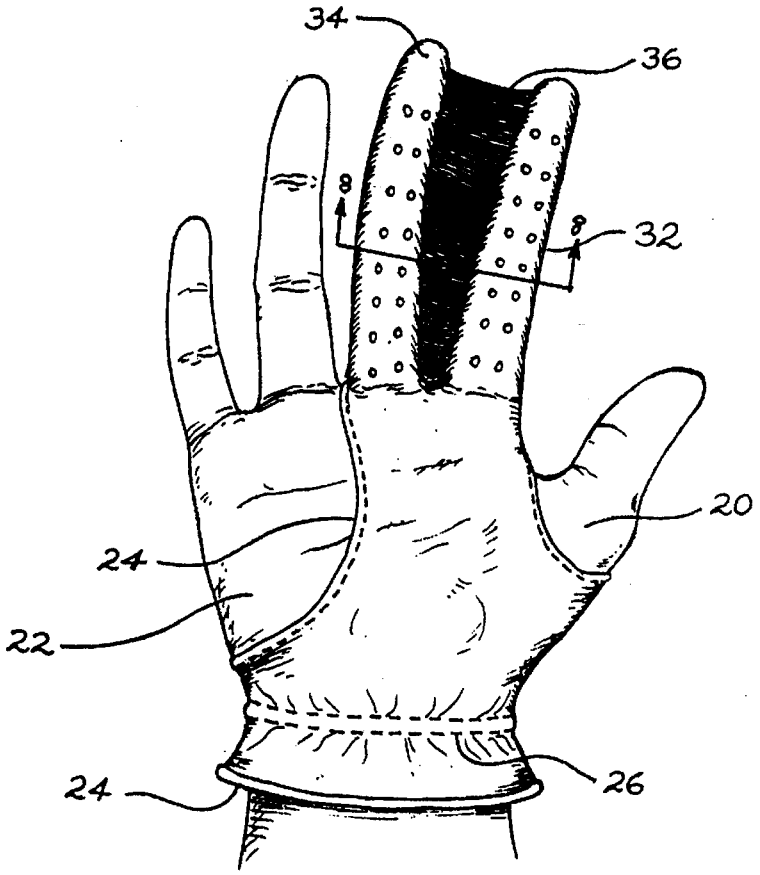
FIG. 2 is a front elevation view of the glove on a hand.
Figure 3:
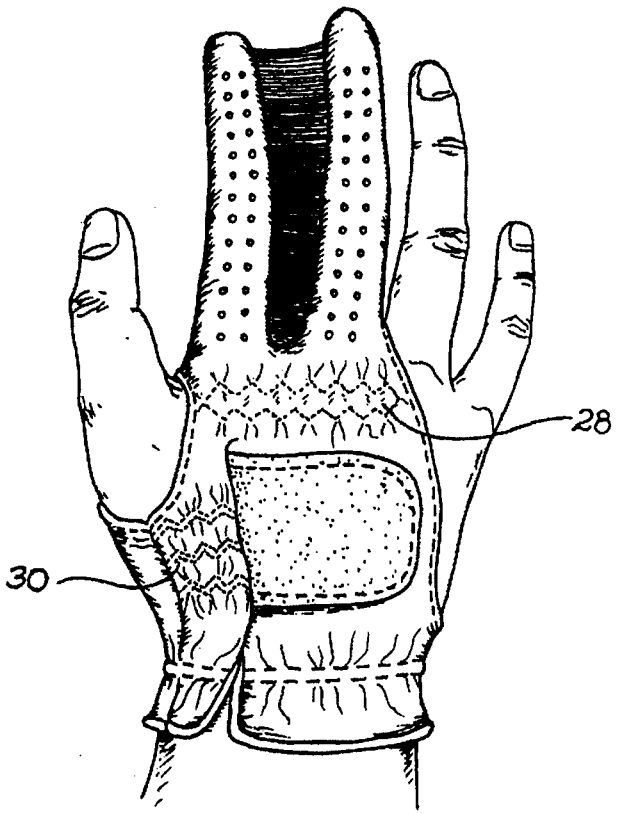
FIG. 3 is a rear elevation view of the glove on the hand with the hook-and-loop fastener tab in place.
Figure 4A:
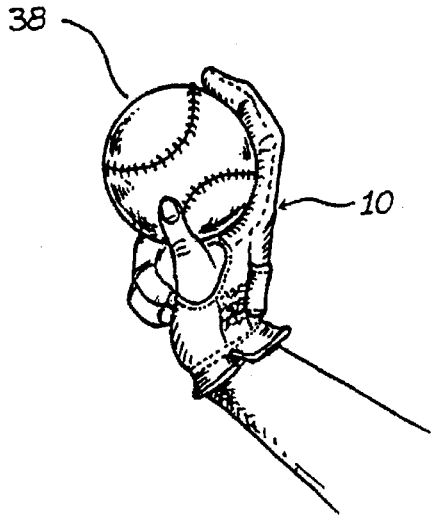
FIGS. 4*a* through 4*c* illustrates a ball being thrown and illustrating how it rolls off the fingers using the glove.
Figure 4B:
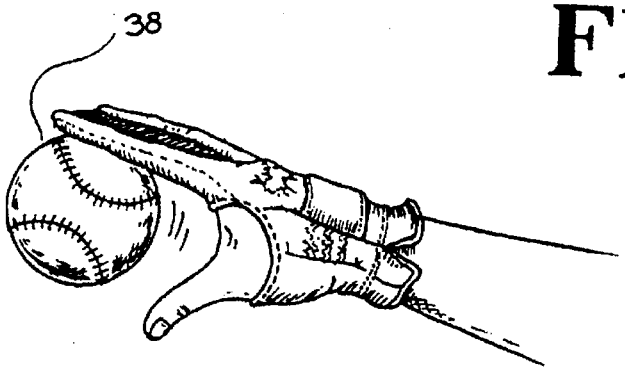
Figure 4C:
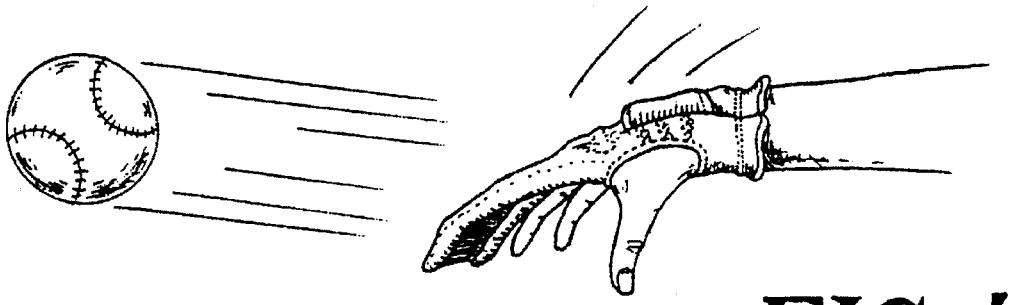
Figure 5:
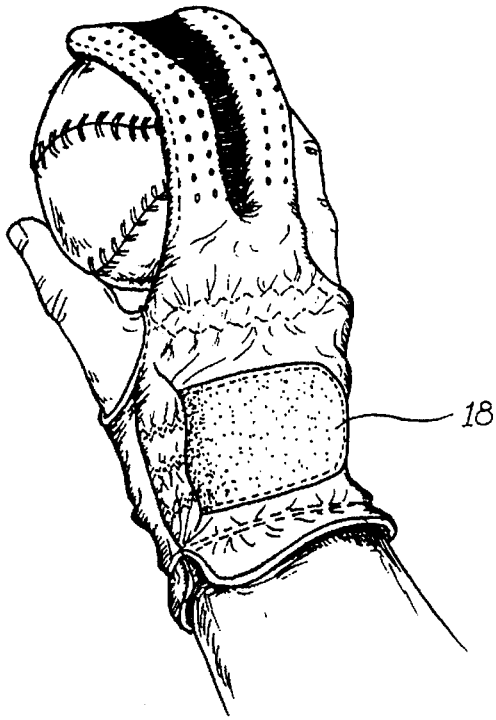
FIG. 5 illustrates the glove on a hand poised in the proper position to pitch a baseball.
Figure 6:
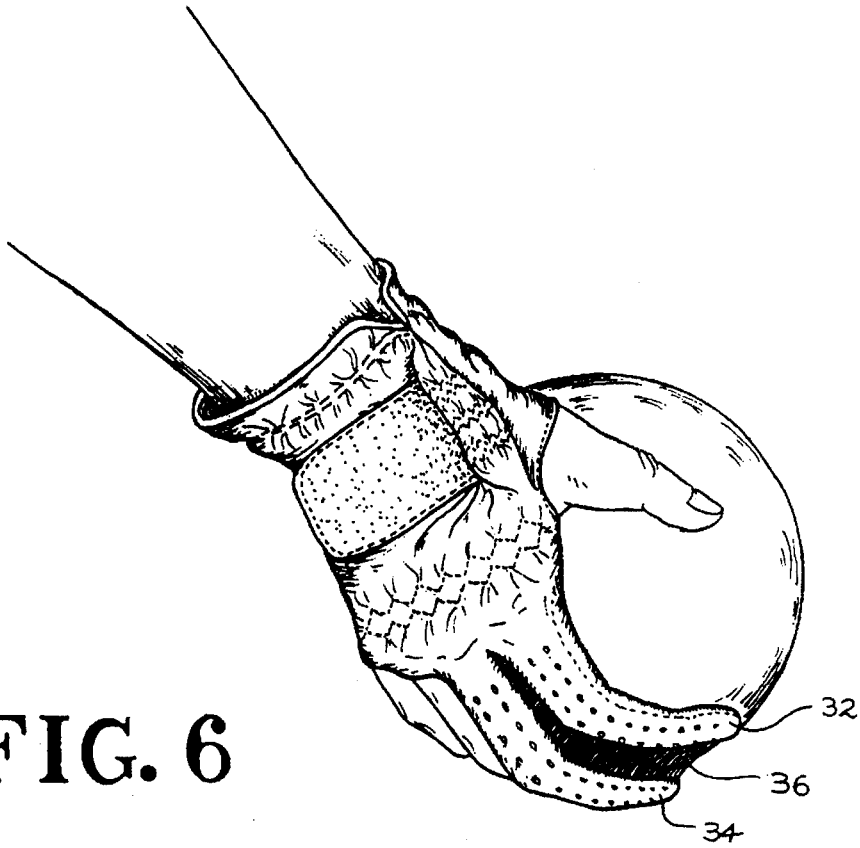
FIG. 6 illustrates the glove on a hand poised in the proper position to pitch a softball.
Figure 7:
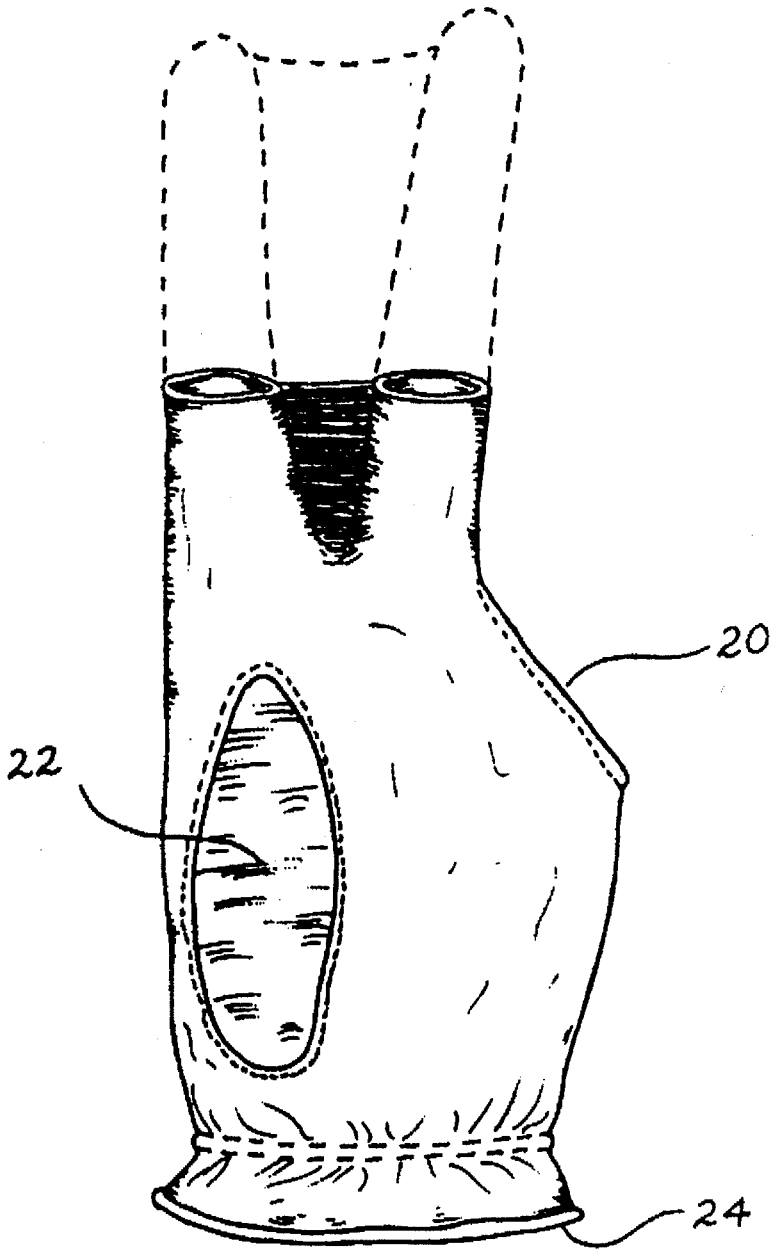
FIG. 7 illustrates a glove without the hand which is sectioned across the fingers to expose the inside of the finger sleeve construction.

The glove of the invention is indicated at 10, having a body portion 12 with front and back panels 14 and 16 which are actually the respective halves of the same cloth panel. The front and back panel are connected to one another with hook- and -loop connector material 18.

On the hand, the body of the glove defines large open areas 20 and 22 for the thumb, and the two smallest fingers, respectively. These openings, as well as the wrist opening, are finished in a smooth hem 24, which is shown as being uniform in all three areas, but could actually be modified so that it would be more elastic in the upper two open areas. I will be noted that the open areas are designed to maximize the non-covered areas of the hand almost like a finger protector for an archer's bow. This is because the player needs to have maximum feel and flex of his hand for throwing the ball. Not only are these wide open areas maximized, but the material of the glove itself is a thin simulated leather or soft split cow hide, or other material that is flexible and semielastic and the entire glove is carefully shaped so that it can cling fairly closely to the hand, especially at the palm and along the two fingers.

To assist in removing all possible puckers in the cloth, three areas of the glove are constriction areas, having a zig-zag or other pattern of plastic sewn directly into the fabric which tends to pull the cloth laterally inwardly from both sides, as well as pulling it in end-wise to a certain extent. These areas are shown at 26, 28, and 30, covering the wrist, knuckles and an area alongside the thumb, respectively. These same areas are constricted in high quality golf gloves, primarily for the comfort of the golfer but also to a certain extent for assistance in accurate strokes. In this instance however, the constructions are elevated in there level of need to necessity, inasmuch as the pitcher must have a snug fit as obviously wrinkles and puckers between his hand and the ball would reduce pitching accuracy and predictability.

Turning now to the principal features of the invention, between the two open areas 20 and 22, the glove extends to cover the index and middle fingers with finger sleeves 32 and 34, again snugly but of course not tightly. It is very important the cloth be of proper material, as it cannot constrict the movement of the hand due to being under tension, but yet must cling and be snug to the fingers. It should be relatively thin, but not have a plastic-like, slick texture but rather be soft and pliable, defining a gripping surface.

Figure 8:
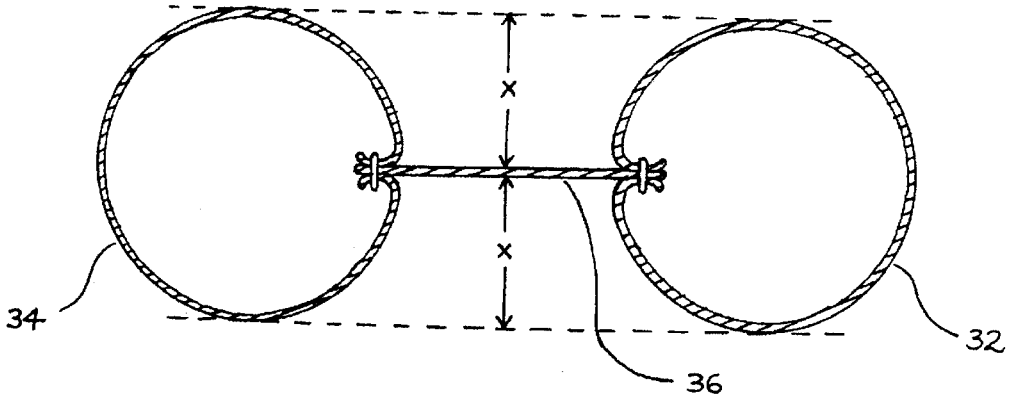
FIG. 8 is a section taken along line 8—8 of FIG. 2 illustrating how the web is hemmed into the cloth of the finger sleeves and demonstrating that the web is sewn at the centerline of both fingers, at the midway position between the from and rear finger surfaces; and, FIG. 9 is a diagrammatic illustration of the ball rolling off of the glove as it would in a pitch, showing the way that it distorts and tracks the last inch or so of the web.

The web 36 is sewn into the centerline of both fingers in a three-panel stitch which is essentially invisible from outside and produces the minimum bulk inside. The web is positioned front-to-back at about the 50% point as can be seen in FIG. 8, and is not formed along the front, palmed surface of the glove as one might expect. This configuration permits the ball to be handled by the hand essentially unobstructed by the web, as though the web were not there, until it reaches the terminus of the pitching stroke, and rolls along the last inch of the web. This is the point at which the web is most useful in actual play as opposed to training. It is conceivable that the narrowest 20% or even 50% of its length could be omitted entirely, leaving only the outer inch and a half, although it is questionable whether this would have any advantages over the full length web and probably would not work as well.

The web limits the ability of the two fingers to expand beyond about 20 degrees. This may vary with experimentation and from player to player, so that the glove can be made in a range of widths, or custom-tailored based on the way the individual player holds his fingers when he is throwing the ball the best.

Figure 9:
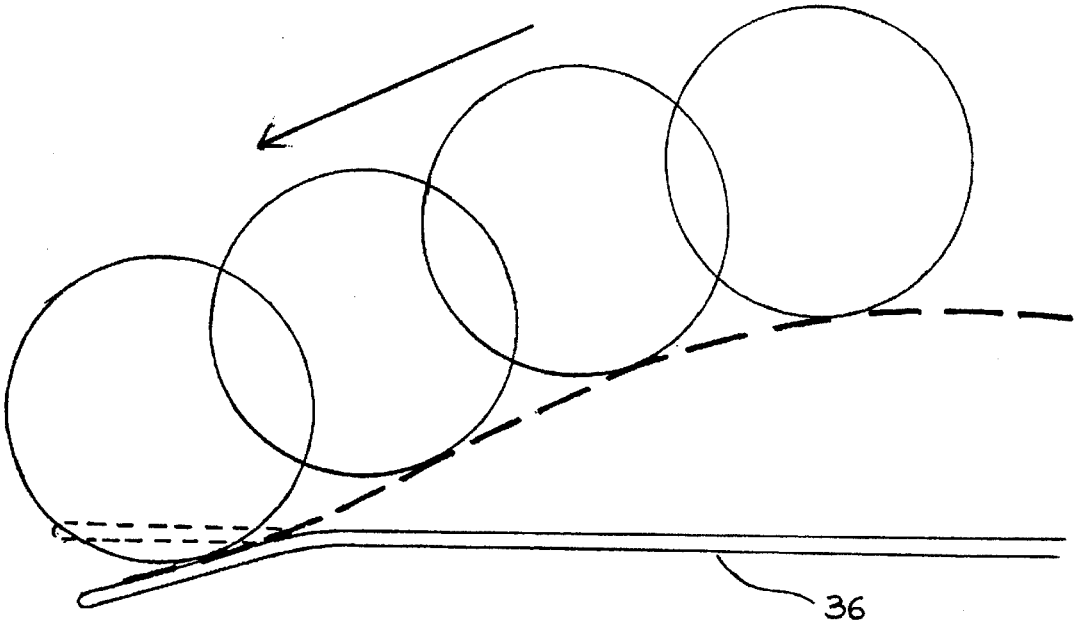

As shown in FIG. 9, as the ball exits the hand it is in full contact with the web 36 and the two figures on either side of the web. The surface area of the glove which is contacting the ball 38 under some force is multiplied by a factor of at least two, and this control extends out to the very end of the pitching stroke, increasing the duration of control over the ball in a manner slightly akin to a Jai Alai racket, but of course not nearly in the same manner or to the extent inasmuch as it is a glove, and not a racket or artificial device. It is not intended to be used as a mechanical accessory to provide an unfair advantage, but rather maximizes the player's control over his own God-given body parts.

Due to the difficulty inherent in constraint to two dimensions and the fact that training is so individualized, this disclosure does not go into the proper grip and finger position for pitching. The glove will accommodate any pitching style, as in all forms and styles there is a need to keep the fingers more or less together and stable.

As far as is known, there is no playing aid of this nature for baseball or softball. There are a number of baseball playing aids, but they are almost all designed for batting practice, inasmuch as batting is the real focal point of the game, since that is the way points are scored. Pitching, on the other hand, is very often the way in which games are won, and accurate pitching begins with consistently holding the fingers in the proper position so the ball always comes off of the fingers the same way and does not roll off the left side of the index finger this time, and the right side next time.

Once the pitcher has this feeling memorized by his hand, then he can begin improving the nuances of his pitch. The glove will help him achieve this stability. It is impossible to make minute changes in one's pitch if the ball is variously rolling off the fingers in a different direction, making significant variations in ball trajectory which may be an order of magnitude greater than the effects of the pitching nuances that also need correcting. For this reason, the glove is primarily a training aid, to be used only in practice, and only secondarily as a piece of equipment used in play.

I claim:

1. A method of pitching a ball with a pitching hand in a controlled fashion comprising the following steps:

(a) engaging a glove having sleeves covering only the index and middle fingers on said pitching hand with a web restraint spanning between said sleeves for limiting the angle of divergence of said sleeves; and, (b) while said fingers are restrained, pitching a ball by letting it roll off the middle and index fingers in the pitching direction while said fingers are maintained spread apart to substantially said maximum angle permitted by said web restraint, such that the ball being pitched rolls off of the web just prior to leaving the hand to extend a duration of frictional control over the ball during the pitch.

* * * * *